US010204589B2

(12) United States Patent
Kim et al.

(10) Patent No.: US 10,204,589 B2
(45) Date of Patent: Feb. 12, 2019

(54) SOURCE DRIVER HAVING LOW POWER CONSUMPTION AND DISPLAY DEVICE INCLUDING THE SOURCE DRIVER

(71) Applicant: SILICON WORKS CO., LTD., Daejeon-si (KR)

(72) Inventors: Young Bok Kim, Daejeon-si (KR); Young Tae Kim, Seoul (KR); Joon Ho Na, Daejeon-si (KR)

(73) Assignee: SILICON WORKS CO., LTD., Daejeon (KR)

( * ) Notice: Subject to any disclaimer, the term of this patent is extended or adjusted under 35 U.S.C. 154(b) by 103 days.

(21) Appl. No.: 14/875,938

(22) Filed: Oct. 6, 2015

(65) Prior Publication Data

US 2016/0098951 A1 Apr. 7, 2016

(30) Foreign Application Priority Data

Oct. 6, 2014 (KR) ..... 10-2014-0134177

(51) Int. Cl.
*G09G 3/20* (2006.01)
*G09G 3/36* (2006.01)

(52) U.S. Cl.
CPC ..... *G09G 3/3688* (2013.01); *G09G 3/3614* (2013.01); *G09G 2310/0248* (2013.01); *G09G 2310/0291* (2013.01); *G09G 2330/021* (2013.01); *G09G 2330/022* (2013.01); *G09G 2330/023* (2013.01)

(58) Field of Classification Search
CPC ..... G09G 3/2092; G09G 3/3688; G09G 2310/0291; G09G 2330/023; G09G 2330/022; G09G 2330/021; G09G 2310/0248; G09G 3/3614
See application file for complete search history.

(56) References Cited

U.S. PATENT DOCUMENTS

2015/0002503 A1* 1/2015 Park ..... G09G 3/3696 345/212

FOREIGN PATENT DOCUMENTS

| | | |
|---|---|---|
| KR | 10-2012-0059351 | 6/2012 |
| KR | 10-2012-0085076 | 7/2012 |
| KR | 10-1182538 | 9/2012 |

* cited by examiner

*Primary Examiner* — Temesghen Ghebretinsae
*Assistant Examiner* — Yaron Cohen
(74) *Attorney, Agent, or Firm* — Kile Park Reed & Houtteman PLLC

(57) ABSTRACT

Disclosed are a source driver and a display device including the same. The source driver may include: an output buffer unit including a pair of output buffers controlled by a first power down signal and another pair of output buffers controlled by a second power down signal; and a charge sharing unit configured to control output buffers to share charge when the first or second power down signal is enabled, the output buffers being driven in the same driving range among the pair of output buffers and the other pair of output buffers.

11 Claims, 6 Drawing Sheets

SOURCE DRIVER HAVING LOW POWER CONSUMPTION AND DISPLAY DEVICE INCLUDING THE SOURCE DRIVER

BACKGROUND

1. Technical Field

The present disclosure relates to a source driver and a display device including the same.

2. Related Art

With the rapid development of semiconductor technology, display devices have been reduced in size and weight. A flat panel display device such as liquid crystal display (LCD) or organic light emitting diode (OLED) display can be easily reduced in size and weight, but has relatively low power consumption. Thus, a driving device used in the display device (for example, a source driver and a gate driver) also requires low power consumption.

PRIOR ART DOCUMENT

Patent Document (Patent Document 1) KR 10-2012-0059351 (published on Jun. 8, 2012)

SUMMARY

Various embodiments are directed to a source driver having low power consumption.

Also, various embodiments are directed to a display device having lower power consumption.

In an embodiment, a source driver may include: an output buffer unit including a pair of output buffers controlled by a first power down signal and another pair of output buffers controlled by a second power down signal; and a charge sharing unit configured to control output buffers to share charge when the first or second power down signal is enabled, the output buffers being driven in the same driving range among the pair of output buffers and the other pair of output buffers.

In an embodiment, a source driver may include: a first output buffer controlled by a first power down signal, and coupled to a first output terminal; a second output buffer controlled by a second power down signal different from the first power down signal, and coupled to a second output terminal different from the first output terminal; and a first charge sharing switch coupled between the first and second output terminals. At a first period, the first and second power down signals may be disabled, and at a second period different from the first period, the first power down signal may be disabled, the second power down signal may be enabled, the first charge sharing switch may be turned on, and the first output buffer may provide the same voltage to the first and second output terminals.

In an embodiment, there is provided a display device including a source driver coupled to a plurality of data lines of a display panel. The source driver may include: a first output buffer controlled by a first power down signal, and coupled to a first output terminal; a second output buffer controlled by a second power down signal different from the first power down signal, and coupled to a second output terminal; and a first charge sharing switch coupled between the first and second output terminals. At a first period, the first and second power down signals may be disabled, and at a second period different from the first period, the first power down signal may be disabled, the second power down signal may be enabled, the first charge sharing switch may be turned on, and the first output buffer may provide the same voltage to the first and second output terminals.

The first period may include a normal display period, and the second period may include a blank period.

DETAILED DESCRIPTION

Figure 1:
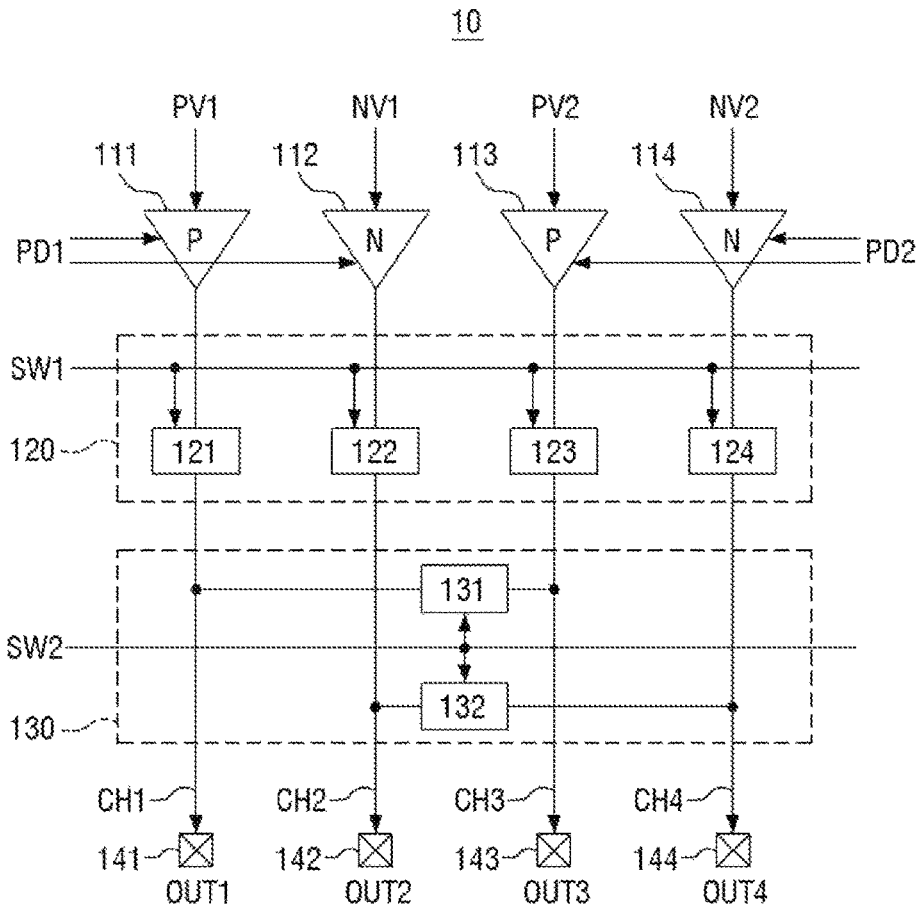
FIG. 1 is a block diagram for describing a part of a source driver in accordance with an embodiment of the present invention.

Exemplary embodiments will be described below in more detail with reference to the accompanying drawings. The disclosure may, however, be embodied in different forms and should not be constructed as limited to the embodiments set forth herein. Rather, these embodiments are provided so that this disclosure will be thorough and complete, and will fully convey the scope of the disclosure to those skilled in the art. Throughout the disclosure, like reference numerals refer to like parts throughout the various figures and embodiments of the disclosure.

When one element is referred to as being "connected to" or "coupled to" another element, it may indicate that the former element is directly coupled or coupled to the latter element or another element is interposed therebetween. On the other hand, when one element is referred to as being "directly connected to" or "directly coupled to" another element, it may indicate that no element is interposed therebetween. Throughout the disclosure, like reference numerals refer to like elements. Furthermore, "and/or" includes each of described items and one or more combinations thereof.

Although the terms such as first and second are used to describe various elements, components, and/or sections, the elements, components, and/or sections are not limited to the terms. The terms are used only to distinguish one element, component, or section from another element, component, or section. Thus, a first element, first component, or first section described below may indicate a second element, second component, or second section within the scope of the present invention.

The terms used in this specification are used only to explain embodiments while not limiting the present invention. In the specification, the terms of a singular form may include plural forms unless referred to the contrary. The meaning of "comprise" or "comprising" used in the specification specifies a component, a step, an operation, and/or element but does not exclude other components, steps, operations, and/or elements.

All of the terms used in this specification will be used as meanings which can be commonly understood by those skilled in the art to which the present invention pertains, as long as the terms are defined as different meanings. The terms may include technical and scientific terms. Furthermore, terms defined in generally used dictionaries must not be analyzed ideally or overstated unless defined specifically.

FIG. 1 is a block diagram for describing a part of a source driver in accordance with an embodiment of the present invention.

Referring to FIG. 1, the source driver 10 in accordance with the embodiment of the present invention includes an output buffer unit, an output unit 120, a charge sharing unit 130, and output terminals 141 to 144. The output buffer unit includes a plurality of output buffers 111 to 114.

The plurality of output buffers 111 to 114 may include first to fourth output buffers 111 to 114, for example. The first to fourth output buffers 111 to 114 may be coupled to the output terminals 141 to 144 corresponding one-to-one thereto. FIG. 1 illustrates four output buffers 111 to 114, but the present invention is not limited thereto. That is, depending on the number of channels, the number of output buffers 111 to 114 may be changed.

Each of the channels CH1 to CH4 may indicate a region distinguished for each data line. The channels CH1 to CH4 include the output terminals 141 to 144, the output buffers 111 to 114, and paths which connect the output buffers 111 and 114 with the output terminals 111 and 114, respectively. Each of the channels CH1 to CH4 is coupled to the corresponding data line.

The output buffers 111 to 114 may output the data voltages OUT1 to OUT4 to the corresponding data lines through the output terminals 141 to 144.

The first and third output buffers 111 and 113 may serve as positive output buffers, and the second and fourth output buffers 112 and 114 may serve as negative output buffers. The first and third output buffers 111 and 113 receive positive voltages PV1 and PV2 from a positive digital analog converter (PDAC), and output positive data voltages OUT1 and OUT3, respectively. The second and fourth output buffers 112 and 114 receive negative voltages NV1 and NV2 from a negative digital analog converter (NDAC), and butter and output negative data voltages OUT2 and OUT4, respectively.

A pair of first and second output buffers 111 and 112 may be controlled by a first power down signal PD1, and another pair of third and fourth output buffers 113 and 114 may be controlled by a second power down signal PD2 different from the first power down signal PD1. For example, during a blank period, the second power down signal PD2 may be enabled while the first power down signal PD1 is disabled. The first and third output buffers 111 and 113 serving as positive output buffers have the same driving range, and the second and fourth output buffers 112 and 114 serving as negative output buffers have the same driving range.

That is, according to the enabled second power down signal PD2, the third and fourth output buffers 113 and 114 may enter a power down mode. When the third and fourth output buffers 113 and 114 enter the power down mode, the current consumption of the output buffers 113 and 114 may become zero, and outputs of the third and fourth output buffers 113 and 114 may be set in a floating state.

The output unit 120 may include a plurality of data line switches 121 to 124. The first data line switch 121 is arranged between the first output buffer 111 and the first output terminal 141, the second data line switch 122 is arranged between the second output buffer 112 and the second output terminal 142, the third data line switch 123 is arranged between the third output buffer 113 and the third output terminal 143, and the fourth data line switch 124 is arranged between the fourth output buffer 114 and the fourth output terminal 144. The plurality of data line switches 121 to 124 may be turned on/off in response to the first switching signal SW1. The first switching signal SW1 may include a signal obtained by inverting a source output enable signal SOE.

The charge sharing unit 130 may include a plurality of charge sharing switches 131 and 132. The charge sharing unit 130 controls the first and third output buffers 111 and 113 and the second and fourth output buffers 112 and 114 to share charge in response to a second switching signal SW2, the first and third output buffers 111 and 113 and the second and fourth output buffers 112 and 114 having the same driving range among the pair of first and second output buffers 111 and 112 and the other pair of third and fourth output buffers 113 and 114. The second switching signal SW2 may be defined as a signal which is enabled at the blank period of the display device. For example, the second switching signal SW2 may be enabled when the first or second power down signal PD1 or PD2 is enabled.

The charge sharing unit 130 may couple the plurality of channels CH1 to CH4 which receive data voltages with the same polarity. For example, the first charge sharing switch 131 may be coupled between the first and third channels CH1 and CH3, and the second charge sharing switch 132 may be coupled between the second and fourth channels CH2 and CH4.

The plurality of charge sharing switches 131 and 132 may be turned on/off in response to the second switching signal SW2.

Furthermore, the turn-on/off of the first and second charge sharing switches 131 and 132 may be determined according to the operation period. For example, at a first period (for example, normal display period), both of the first and second charge sharing switches 131 and 132 may be turned off. Furthermore, at a second period (for example, blank period), both of the first and second charge sharing switches 131 and 132 may be turned on. That is, the first and third channels CH1 and CH3 may be electrically shorted, and the second and fourth channels Ch2 and CH4 may be electrically shorted.

Figure 2:
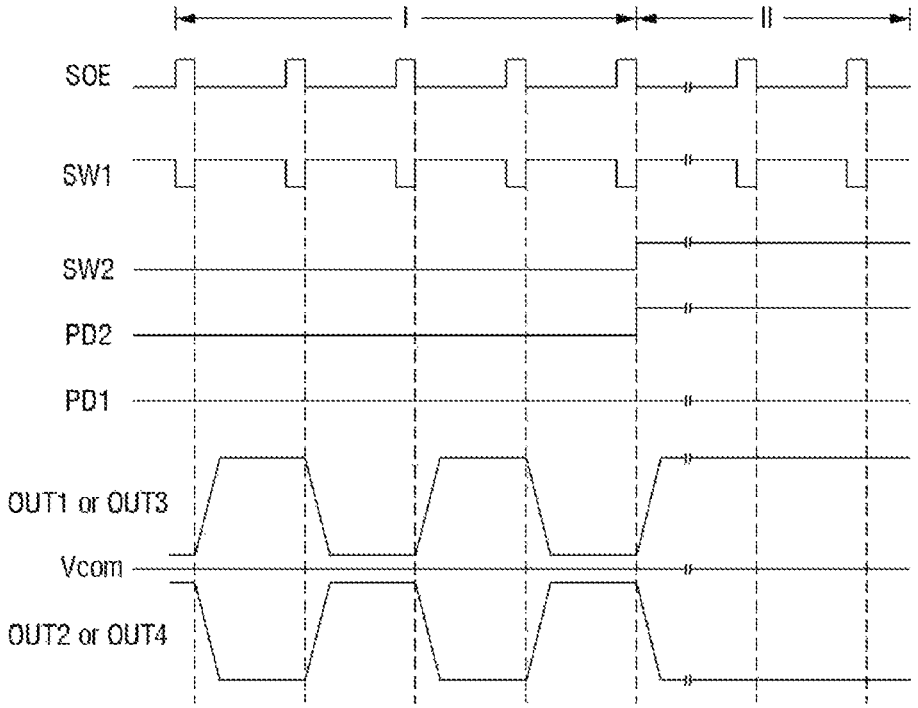
FIG. 2 is a block diagram for describing a method for driving the source driver of FIG. 1.

Thus, at the blank period, the first power down signal PD1 is disabled, and the second power down signal PD2 is enabled. That is, the first and second output buffers 111 and 112 perform a normal operation, and the third and fourth output buffers 113 and 114 enter the power down mode. At this time, since the first and second charge sharing switches 131 and 132 are turned on, the first output buffer 111 may provide the same voltage to the first and third channels CH1 and CH3. Similarly, the second output buffer 112 may provide the same voltage to the second and fourth channels CH2 and CH4. FIG. 2 is a timing diagram for describing a method for driving the source driver of FIG. 1.

Referring to FIGS. 1 to 2, a first period I may correspond to the normal display period, and a second period II may correspond to the blank period.

During the first period I, the first power down signal PD1 and the second power down signal PD2 are disabled (for example, low level). Thus, the first to fourth output buffers 111 to 114 perform a normal operation. That is, since the first and third output buffers 111 and 113 are positive output buffers, the data voltages OUT1 and OUT3 may swing in a region where the data voltages OUT1 and OUT3 are higher than a common voltage Vcom. Furthermore, since the second and fourth output buffers 112 and 114 are negative output buffers, the data voltages OUT2 and OUT4 may swing in a region where the data voltages OUT2 and OUT3 are lower than the common voltage Vcom. The source output enable signal SOE is periodically enabled to determine the output timings of the data voltages OUT1 to OUT4. As described above, the first switching signal SW1 may include a signal obtained by inverting the source output enable signal SOE. Thus, whenever the source output enable signal SOE is enabled to a high level, the output buffers 111 to 114 output the first to fourth data voltages OUT1 to OUT4.

The second switching signal SW2 is disabled (for example, low level). Thus, the plurality of charge sharing switches 131 and 132 are turned off. Therefore, the channels CH1 to CH4 may be electrically isolated from each other, and the channels CH1 to CH4 may receive the data voltages OUT1 to OUT4 from the corresponding output buffers 111 to 114.

During the second period II, the first power down signal PD1 maintains the disabled state, and the second power down signal PD2 is enabled (for example, high level). Thus, the third and fourth output buffers 113 and 114 enter the power down mode.

Furthermore, the second switching signal SW2 is enabled (for example, high level). Thus, the plurality of charge sharing switches 131 and 132 are turned on. That is, the first and third channels CH1 and CH3 are electrically shorted, and the second and fourth channels Ch2 and CH4 are electrically shorted.

Thus, the first output buffer 111 may provide the same voltage to the first and third channels CH1 and CH3. The second output buffer 112 may provide the same voltage to the second and fourth channels CH2 and CH4.

At the second period II, s output buffers may provide a voltage to t channels where t is a natural number equal to or more than two and s is a natural number smaller than t. FIG. 1 illustrates that two output buffers 111 and 112 provide a voltage to four channels CH1 to CH4, but the present invention is not limited thereto. When the data voltages OUT1 to OUT4 do not need to be divided into positive and negative voltages, one output buffer (for example, 111) may provide a voltage to four channels CH1 to CH4.

Thus, since the number of output buffers 111 and 112 used at the second period II is smaller than the number of output buffers 111 to 114 used at the first period I, the power consumption of the second period II may be reduced.

Figure 3:
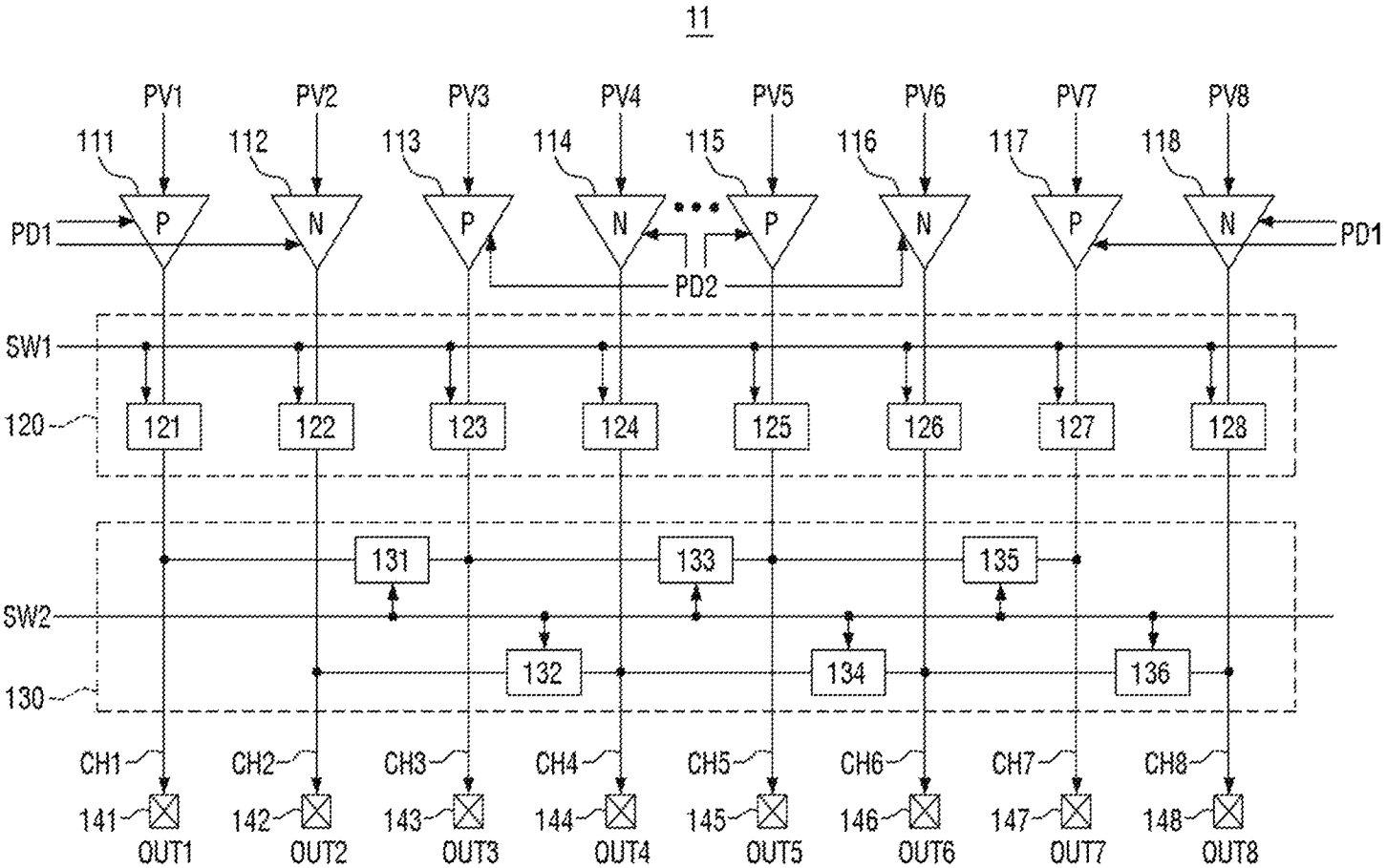
FIG. 3 is a block diagram for describing a part of a source driver in accordance with another embodiment of the present invention.

FIG. 3 is a block diagram for describing a part of a source driver in accordance with another embodiment of the present invention. The following descriptions will be focused on differences from those described with reference to FIGS. 1 to 2.

Referring to FIG. 3, the source driver 11 in accordance with the embodiment of the present invention includes a plurality of output buffers 111 to 118, an output unit 120, and a charge sharing unit 130.

The plurality of output buffers 111 to 118 may include first to eighth output buffers 111 to 118, for example. The first to eighth output buffers 111 to 118 may be coupled to channels CH1 to CH8 corresponding one-to-one thereto. The first, third, fifth, and seventh output buffers 111, 113, 115, and 117 may serve as positive output buffers, and the second, fourth, sixth, and eighth output buffers 112, 114, 116, and 118 may serve as negative output buffers.

The first, second, seventh, and eighth output buffers 111, 112, 117, and 118 may be controlled by a first power down signal PD1, and the third to sixth output buffers 113 to 116 may be controlled by a second power down signal PD2 different from the first power down signal PD1.

The output unit 120 may include a plurality of data line switches 121 to 128. The plurality of data line switches 121 to 128 may be turned on/off in response to the first switching signal SW1.

The charge sharing unit 130 may include a plurality of charge sharing switches 131 to 136. The charge sharing unit 130 may couple the plurality of channels CH1 to CH8 which receive data voltages with the same polarity. For example, the first charge sharing switch 131 may be coupled between the first and third channels CH1 and CH3, and the second charge sharing switch 132 may be coupled between the second and fourth channels CH2 and CH4. The third charge sharing switch 133 may be coupled between the third and fifth channels CH3 and CH5, and the fourth charge sharing switch 134 may be coupled between the fourth and sixth channels CH4 and CH6. The fifth charge sharing switch 135 may be coupled between the fifth and seventh channels CH5 and CH7, and the sixth charge sharing switch 136 may be coupled between the sixth and eighth channels CH6 and CH8.

At the blank period, the first power down signal PD1 is disabled, and the second power down signal PD2 is enabled. Between the output buffers 111, 112, 117, and 118 operating at the blank period, the output buffers 113, 114, 115, and 116 entering the power down mode may be arranged. In other words, the third to sixth channels CH3 to CH6 may be arranged between the first and second channels CH1 and CH2 and the seventh and eighth channels CH7 and CH8, or data lines in a display panel, which are coupled to the first, second, seventh, and eighth channels CH1, CH2, CH7, and CH8, may be arranged at both ends of the display panel.

Thus, the data voltages OUT1 and OUT7 outputted from the output buffers 111 and 117 arranged at both sides are also provided to the channels CH3 and CH5 corresponding to the output buffers 113 and 115 arranged inside. Furthermore, the data voltages OUT2 and OUT8 outputted from the output buffers 112 and 118 arranged at both sides are also provided to the channels CH4 and CH6 corresponding to the output buffers 114 and 116 arranged inside.

Figure 4:
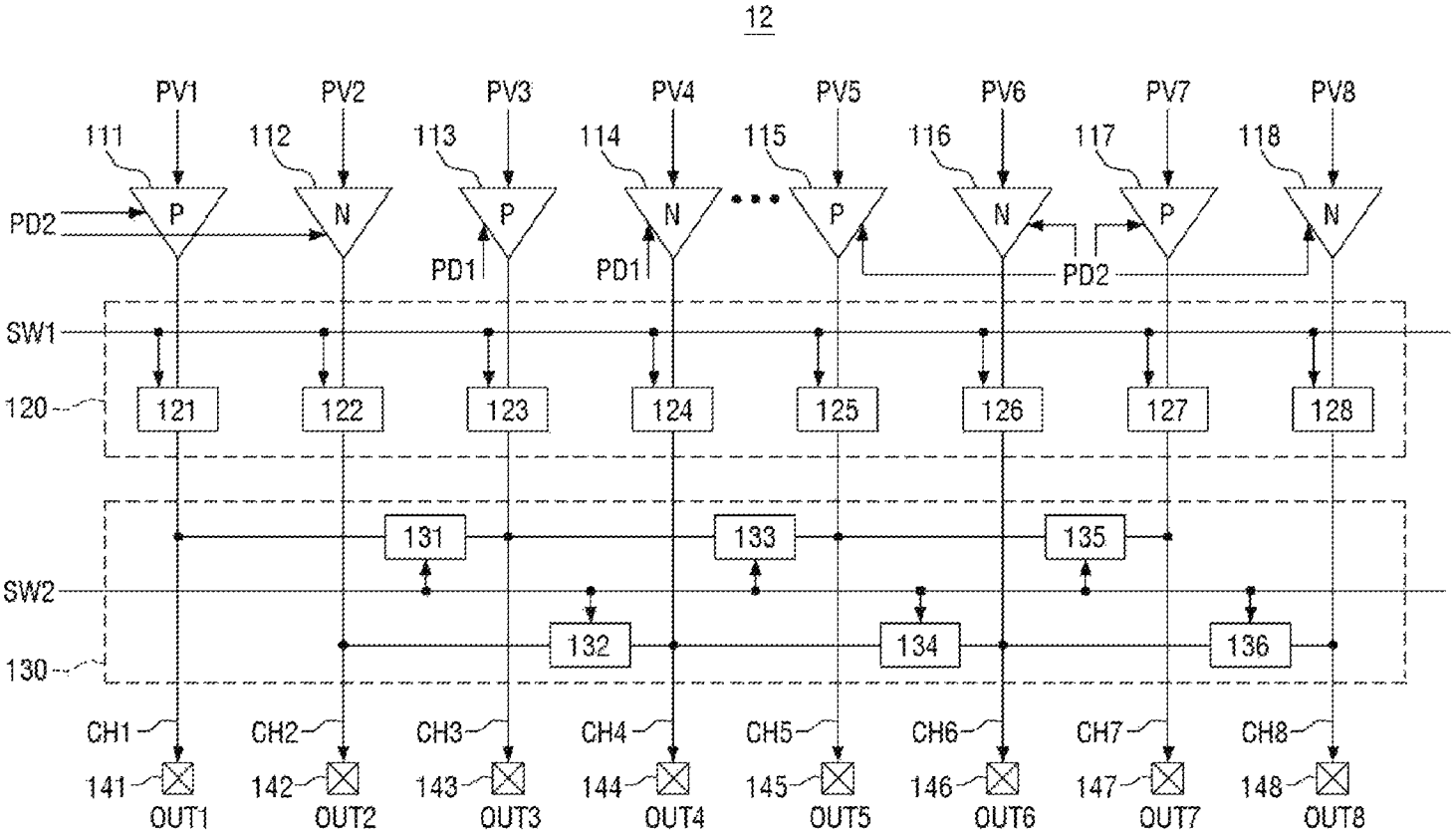
FIG. 4 is a block diagram for describing a part of a source driver in accordance with another embodiment of the present invention.

FIG. 4 is a block diagram for describing a part of a source driver in accordance with another embodiment of the present invention. The following descriptions will be focused on differences from those described with reference to FIG. 3.

Referring to FIG. 4, the third and fourth output buffers 113 and 114 in the source driver 12 in accordance with the embodiment of the present invention may be controlled by the first power down signal PD1, and the other output buffers 111, 112, and 115 to 118 may be controlled by the second power down signal PD2.

During the blank period, the second power down signal PD2 is enabled and the first power down signal PD1 maintains a disabled state, as described above. Thus, at the blank period, the third output buffer 113 may provide the same voltage to the channels CH1, CH5, and CH7 corresponding to the other positive output buffers 111, 115, and 117 as well as the channel CH3. The fourth output buffer 114 may provide the same voltage to the channels CH2, CH6, and CH8 corresponding to the other negative output buffers 112, 116, and 118 as well as the channel CH4.

As described with reference to FIGS. 1 to 4, the plurality of positive output buffers may correspond one-to-one to the plurality of positive channels. Furthermore, the plurality of negative output buffers may correspond one-to-one to the plurality of negative channels. At the first period (for example, normal display period), the plurality of positive output buffers provide a voltage to the plurality of positive channels corresponding thereto, and the plurality of negative output buffers provide a voltage to the plurality of negative channels corresponding thereto. At a second period (for example, blank period), however, a part of the positive output buffers may provide a voltage to all of the positive channels, and a part of the negative output buffers may provide a voltage to all of the negative channels. Thus, the power consumption of the second period II may be minimized.

Figure 5:
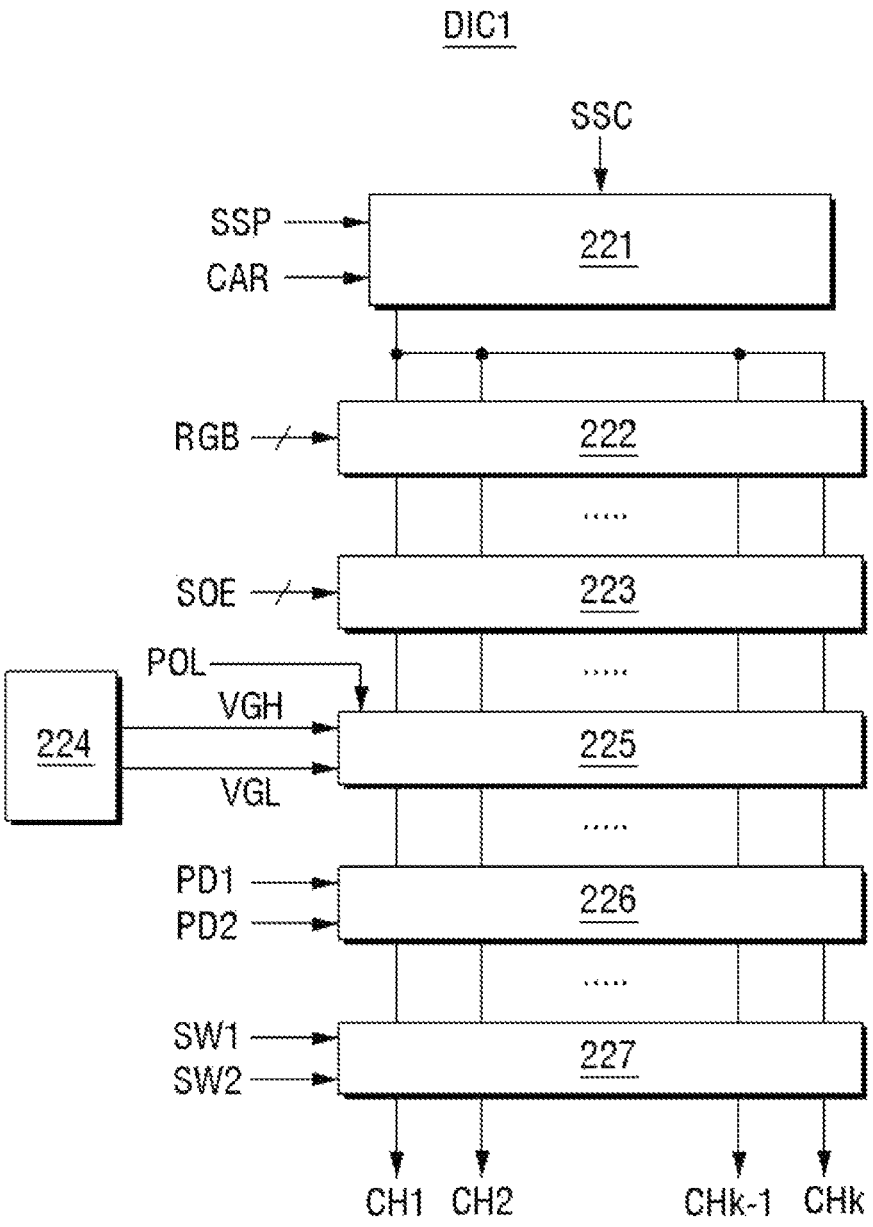
FIG. 5 is a block diagram for describing a source driver in accordance with another embodiment of the present invention.

FIG. 5 is a block diagram for describing a source driver in accordance with another embodiment of the present invention. FIG. 5 illustrates an example in which the source drivers described with reference to FIGS. 1 to 4 are implemented with a data driver integrated circuit DIC1.

Referring to FIG. 5, the data driver integrated circuit DIC1 includes a shift register 221, a first latch array 222, a second latch array 223, a gamma compensation voltage generation unit 224, a digital analog converter (DAC) 225, a buffer circuit 226, and a charge sharing circuit 227.

The shift register 221 is started in response to a source start pulse SSP, and shifts a sampling signal according to a source sampling clock SSC. Furthermore, the shift register 221 generates a carry signal CAR when data exceeding the number of latches included in the first latch array 222 are supplied.

The first latch array 222 samples digital video data RGB inputted from a timing controller in response to the sampling signals which are sequentially inputted from the shift register 221, latches the data RGB on a basis of one horizontal line, and outputs data of one horizontal line at the same time.

The second latch array 223 latches the data of one horizontal line, inputted from the first latch array 222, and outputs the digital video data RGB at the same time as the second latch arrays 223 of other data driver integrated circuits during a logic low period of the source output enable signal SOE.

The gamma compensation voltage generation unit 224 subdivides a plurality of gamma reference voltages by the number of gradations which can be expressed as the bit number of digital video data RGB, and generates positive gamma compensation voltages VGH and negative gamma compensation voltages VGL corresponding to the respective gradations.

The DAC 225 includes a positive decoder to which the positive gamma compensation voltage VGH is supplied, a negative decoder to which the negative gamma compensation voltage VGL is supplied, and a multiplexer which selects an output of the positive decoder and an output of the negative decoder in response to a polarity control signal POL. The positive decoder decodes the digital video data RGB inputted from the second latch array 223, and outputs a positive gamma compensation voltage VGH corresponding to the gradation value of the data. The negative decoder decodes the digital video data RGB inputted from the second latch array 223, and outputs a negative gamma compensation voltage VGL corresponding to the gradation value of the data. The multiplexer selects the positive gamma compensation voltage VGH and the negative gamma compensation voltage VGL in response to the polarity control signal POL.

The buffer circuit 226 includes the output buffers 111 to 114 of FIG. 1. The plurality of output buffers 111 to 114 minimize signal attenuation of an analog data voltage supplied from the DAC 225. The output buffers 111 to 114 may be controlled by the first or second power down signal PD1 or PD2. At the blank period, only the output buffers (for example, 113 and 114) controlled by the second power down signal PD2 may enter the power down mode.

The charge sharing circuit 227 may include the output unit 120 and the charge sharing unit 130 of FIG. 1. In particular, the charge sharing unit 130 may include the plurality of charge sharing switches 131 and 132 of FIG. 1. The charge sharing switches 131 and 132 are turned on at the second period (for example, blank period) and selectively short channels.

Figure 6:
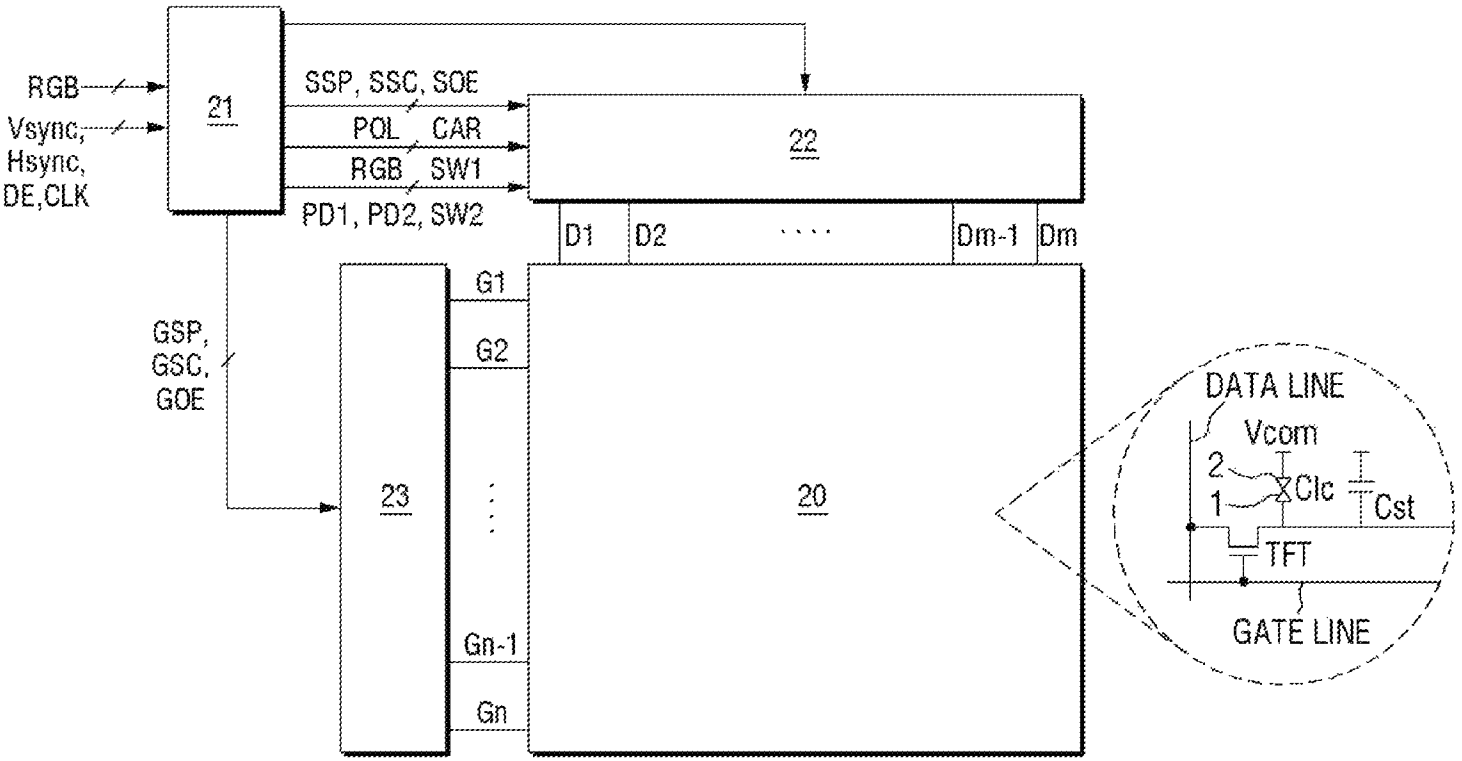
FIG. 6 is a block diagram for describing a display device in accordance with an embodiment of the present invention.

FIG. 6 is a block diagram for describing a display device in accordance with an embodiment of the present invention. FIG. 6 illustrates a display device to which the source drivers described with reference to FIGS. 1 to 5 are applied. For convenience of description, an LCD device will be taken as an example. However, the display device can be applied to a flat panel display device such as OLED.

Referring to FIG. 6, the display device in accordance with the embodiment of the present invention includes a display panel 20, a timing controller 21, a source driver 22, and a gate driver 23.

The display panel 20 includes liquid crystal arranged between two glass substrates, for example. The display panel 20 includes m×n liquid crystal cells Clc arranged in a matrix shape based on the cross structure of data lines D1 to Dm and gate lines G1 to Gn where m and n are positive integers.

The bottom glass substrate of the display panel 20 has a pixel array formed therein, the pixel array including the m data lines D1 to Dm, the n gate lines G1 to Gn, TFTs, pixel electrodes 1 of the liquid crystal cells Clc connected to the respective TFTs, and storage capacitors Cst.

The top glass substrate of the display panel 20 may include a black matrix, a color filter, and a common electrode 2 formed thereon. The common electrode 2 is formed on the top glass substrate in a vertical electric field driving mode such as TN (Twisted Nematic) mode or VA (Vertical Alignment) mode, and formed on the bottom glass substrate with the pixel electrode 1 in a horizontal electric field driving mode such as IPS (In-Plane Switching) mode or FFS (Fringe Field Switching) mode.

Each of the top and bottom glass substrates included in the display panel 20 has a polarizing plate attached thereon and an alignment film formed on the inner surface thereof which is in contact with liquid crystal. The polarizing plate crosses an optical axis at right angles, and the alignment film serves to set a pre-tilt.

The source driver 22 may include one or more of the source drivers described with reference to FIGS. 1 to 5. The source driver 22 latches digital video data RGB under control of the timing controller 21, and generates a positive/negative data voltage by converting the digital video data into an analog positive/negative gamma voltage. The source driver 22 supplies data voltages to the data lines D1 to Dm. The data driver integrated circuits may be mounted on a TCP (Tape Carrier Package) and bonded to the bottom glass substrate of the display panel 20 by a TAB (Tape Automated Bonding) process.

The gate driver 23 includes a shift register, a level shifter for converting an output signal of the shift register into a swing suitable for TFT driving of a liquid crystal cell, and output buffers connected between the level shifter and the gate lines G1 to Gn. The gate driver 23 sequentially supplies scan pulses having a pulse width of one horizontal period to the gate lines G1 to Gn, under control of the timing controller 21. The gate driver 23 may be mounted on a TCP and bonded to the bottom glass substrate of the display panel 20 through the TAB process, or directly formed on the bottom glass substrate with a pixel array by a GIP (Gate driver In Panel) process.

The timing controller 21 realigns digital video data RGB inputted from a system board (not illustrated) according to the display panel 20, and supplies the realigned data to the source driver 22. The timing controller 21 receives a timing signal such as a vertical/horizontal synchronization signal Vsync/Hsync, a data enable signal DE, or a clock signal CLK from the system board, and generates control signals for controlling the operation timings of the source driver 22 and the gate driver 23.

The data timing control signal for controlling the source driver 22 includes a source start pulse SSP, a source sampling clock SSC, a polarity control signal POL, and a source output enable signal SOE. The source start pulse SSP controls a data sampling start timing of the source driver 22. The source sampling clock SSC is a clock signal for controlling a sampling timing of data in the source driver 22, based on a rising or falling edge. The source output enable signal SOE controls an output timing of the source driver 22. The polarity control signal POL controls a horizontal polarity inversion timing of a data voltage outputted from the source driver 22. The logic inversion cycle of the polarity control signal POL is selected as a predetermined horizontal period. For example, the logic of the polarity control signal POL is inverted at a cycle of two horizontal periods when the source driver 22 is controlled through vertical 2-dot inversion, and inverted at a cycle of one horizontal period when the source driver 22 is controlled through vertical 1-dot inversion. The polarity inversion cycle of data voltages which are sequentially outputted through the same channel in the source driver 22 depends on the logic inversion cycle of the polarity control signal POL. The polarities of data voltages which are outputted from adjacent channels of the source driver 22 at the same time are preset to be inverted on a predetermined dot basis (for example, one dot).

The first or second power down signal PD1 or PD2 may selectively control a part of the plurality of output buffers to enter the power down mode, and the second switching signal SW2 may selectively turn on/off the plurality of charge sharing switches.

The gate timing control signal for controlling the gate driver 23 includes a gate start pulse GSP, a gate shift clock GSC, a gate output enable signal GOE and the like. During one frame period, the gate start pulse GSP is generated once at the same time as the start of the frame period, and generates a first gate pulse. The gate shift clock GSC is a clock signal which is commonly inputted to a plurality of stages forming the shift register, and shifts the gate start pulse GSP. The gate output enable signal GOE controls an output of the gate driver 23.

While various embodiments have been described above, it will be understood to those skilled in the art that the embodiments described are by way of example only. Accordingly, the disclosure described herein should not be limited based on the described embodiments.

What is claimed is:

1. A source driver comprising:

an output buffer unit comprising a pair of first output buffers enabled in response to a first power down signal disabled at a blank period of a display device, and another pair of second output buffers disabled in response a second power down signal enabled at the blank period, in order to provide a same voltage to a display panel at the blank period, wherein the power down signals are directly fed to the respective output buffers and the blank period corresponds to a power down mode; and a charge sharing unit configured to connect only output terminals corresponding to the output buffers being driven in same polarity to each other in response to a switching signal at the blank period among the pair of first output buffers and the other pair of second output buffers by divided in a positive polarity and a negative polarity wherein the switching signal is enabled when the second power down signal is enabled, wherein at the blank period, the pair of first output buffers provide a first voltage to first output terminals corresponding to positive output buffers and a second voltage to second output terminals corresponding to negative output buffers, and the other pair of second output buffers enter the power down mode.

2. The source driver of claim 1, wherein the output buffer unit comprises:

the pair of first output buffers having a positive output buffer and a negative output buffer which are controlled by the first power down signal; and the other pair of second output buffers having a positive output buffer and a negative output buffer which are controlled by the second power down signal.

3. The source driver of claim 2, wherein the charge sharing unit comprises:

a first charge sharing switch configured to couple output terminals of the positive output buffers in response to the switching signal; and a second charge sharing switch configured to couple output terminals of the negative output buffers in response to the switching signal.

4. A source driver comprising:

a first output buffer enabled in response to a first power down signal disabled at a blank period of a display device, and coupled to a first output terminal, in order to provide a same voltage to a display panel at the blank period, wherein the blank period corresponds to a power down mode and the first power down signal is directly fed to the first output buffer;

a second output buffer disabled in response to a second power down signal enabled at the blank period, and coupled to a second output terminal different from the first output terminal, wherein the second power down signal is directly fed to the second output buffer;

a third output buffer enabled in response to the first power down signal disabled at the blank period, and coupled to a third output terminal different from the first and second output terminals, in order to provide another same voltage to the display panel at the blank period, wherein the first power down signal is directly fed to the third output buffer;

a fourth output buffer disabled in response to the second power down signal enabled at the blank period, and coupled to a fourth output terminal different from the first to third output terminals, wherein the second power down signal is directly fed to the fourth output buffer;

a first charge sharing switch coupled between the first and second output terminals corresponding to the first and second output buffers being driven in positive polarity in response to a switching signal at the blank period, wherein the switching signal is enabled when the second power down signal is enabled; and a second charge sharing switch coupled between the third and fourth output terminals corresponding to the third and fourth output buffers being driven in negative polarity in response to the switching signal at the blank period, wherein at the blank period, the first charge sharing switch connects the first and second output terminals to each other, the first output buffer provides the same voltage to the first and second output terminals, and the second output buffer enters the power down mode, and at the blank period, the second charge sharing switch connects the third and fourth output terminals to each other, the third output buffer provides the another same voltage to the third and fourth output terminals, and the fourth output buffer enters the power down mode.

5. The source driver of claim 4, wherein at a normal display period, the first output buffer provides a first data voltage to the first output terminal, the second output buffer provides a second data voltage to the second output terminal, and the first and second data voltages have the same polarity.

6. The source driver of claim 4, wherein the first charge sharing switch is not coupled to the third output terminal.

7. The source driver of claim 6, wherein the first charge sharing switch is not coupled to the fourth output terminal.

8. The source driver of claim 7, wherein the second charge sharing switch is turned off at a normal display period, and turned on at the blank period.

9. The source driver of claim 8, wherein at the normal period, the third output buffer provides a third data voltage to the third output terminal, the fourth output buffer provides a fourth data voltage to the fourth output terminal, and the third and fourth data voltages have the same polarity as each other and have a different polarity from the first and second data voltages.

10. The source driver of claim 4, further comprising a fifth output buffer controlled by the first power down signal, and coupled to a fifth output terminal different from the first and second output terminals, wherein the second output buffer is arranged between the first and fifth output buffers.

11. A display device comprising a source driver coupled to a plurality of data lines of a display panel, wherein the source driver comprises:

a first output buffer enabled in response to a first power down signal disabled at a blank period of a display device, and coupled to a first output terminal, in order to provide a same voltage to a display panel at the blank period, wherein the blank period corresponds to a power down mode and the first power down signal is directly fed to the first output buffer;

a second output buffer disabled in response to a second power down signal enabled at the blank period, and coupled to a second output terminal, wherein the second power down signal is directly fed to the second output buffer;

a third output buffer enabled in response to the first power down signal disabled at the blank period, and coupled to a third output terminal different from the first and second output terminals, in order to provide another same voltage to the display panel at the blank period, wherein the first power down signal is directly fed to the third output buffer;

a fourth output buffer disabled in response to the second power down signal enabled at the blank period, and coupled to a fourth output terminal different from the first to third output terminals, wherein the second power down signal is directly fed to the fourth output buffer;

a first charge sharing switch coupled between the first and second output terminals corresponding to the first and second output buffers being driven in positive polarity in response to a switching signal at the blank period, wherein the switching signal is enabled when the second power down signal is enabled; and a second charge sharing switch coupled between the third and fourth output terminals corresponding to the third and fourth output buffers being driven in negative polarity in response to the switching signal at the blank period, wherein at the blank period, the first charge sharing switch connects the first and second output terminals to each other, the first output buffer provides the same voltage to the first and second output terminals and the second output buffer enters a power down mode, and at the blank period, the second charge sharing switch connects the third and fourth output terminals to each other, the third output buffer provides the another same voltage to the third and fourth output terminals, and the fourth output buffer enters the power down mode.

* * * * *